United States Patent [19]

Gerber et al.

[11] 4,137,804

[45] Feb. 6, 1979

[54] FLUID CUTTING JET RECEIVER

[75] Inventors: Heinz J. Gerber; David R. Pearl, both of West Hartford, Conn.

[73] Assignee: Gerber Garment Technology, Inc., South Windsor, Conn.

[21] Appl. No.: 840,493

[22] Filed: Oct. 7, 1977

Related U.S. Application Data

[63] Continuation-in-part of Ser. No. 488,158, Jul. 12, 1974, abandoned.

[51] Int. Cl.[2] ..... B26F 3/00; D06H 7/00

[52] U.S. Cl. ..... 83/177; 83/925 CC

[58] Field of Search ..... 83/53, 177, 925 CC, 83/100; 162/286, 194, 195

[56] References Cited

U.S. PATENT DOCUMENTS

| | | | |
|---|---|---|---|
| 3,042,576 | 7/1962 | Harmon et al. | 83/53 X |
| 3,532,014 | 10/1970 | Franz | 83/177 X |
| 3,730,040 | 5/1973 | Chadwick et al. | 83/177 |
| 3,769,488 | 10/1973 | Hasslinger | 83/925 CC |
| 3,877,334 | 4/1975 | Gerber | 83/177 X |
| 3,891,157 | 6/1975 | Justus | 83/177 X |

OTHER PUBLICATIONS

Lavoie, Francis J., Water - Jet Machining in Machine Design, pp. 89-93, Feb. 22, 1973.

*Primary Examiner*—J. M. Meister

*Attorney, Agent, or Firm*—McCormick, Paulding & Huber

[57] ABSTRACT

A cutting machine utilizing a high velocity fluid cutting jet for cutting is provided with a receiver to absorb the cutting jet after it passes through sheet material in a cutting operation. The receiver comprises a jet-deflection chamber having an inlet positioned to receive the fluid jet and an inside wall which turns or deflects the jet in a whirling or circular path to dissipate the energy or momentum of the jet. A drain from the chamber may be provided to continually evacuate the spent fluid of the jet.

29 Claims, 9 Drawing Figures

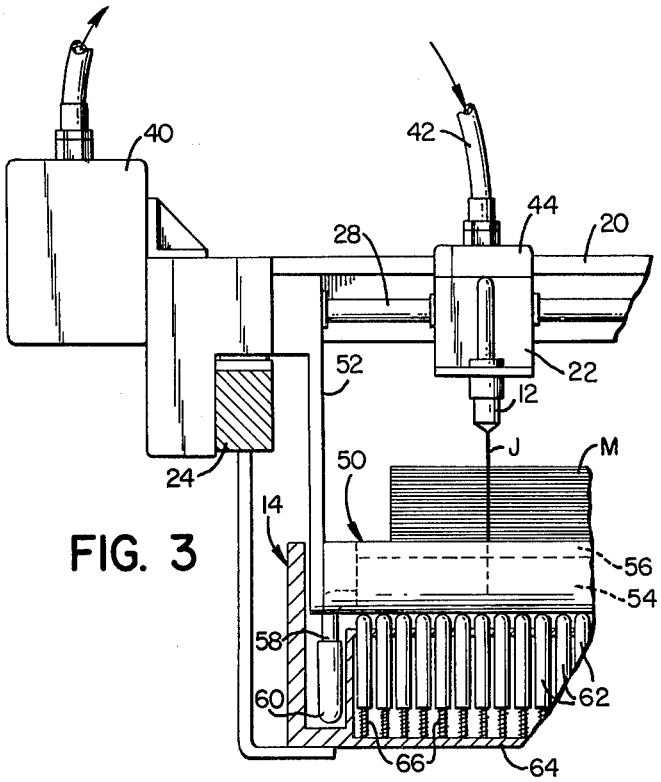
FIG. 3
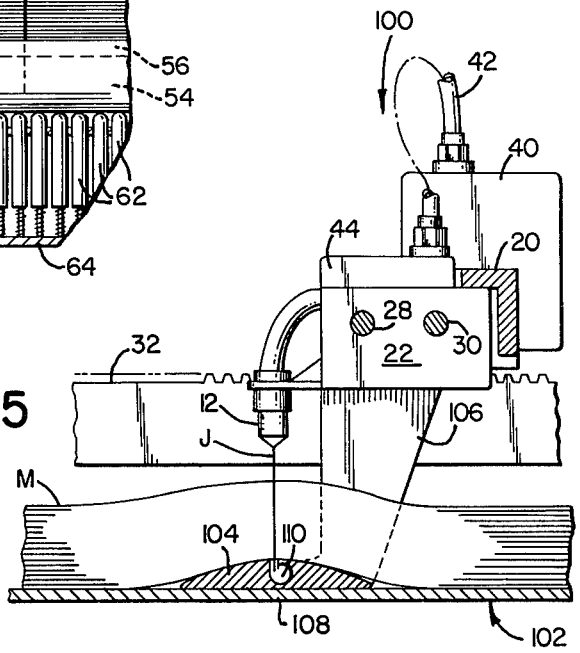
FIG. 5
FIG. 7
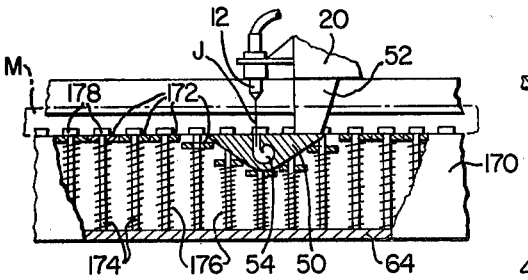
FIG. 6
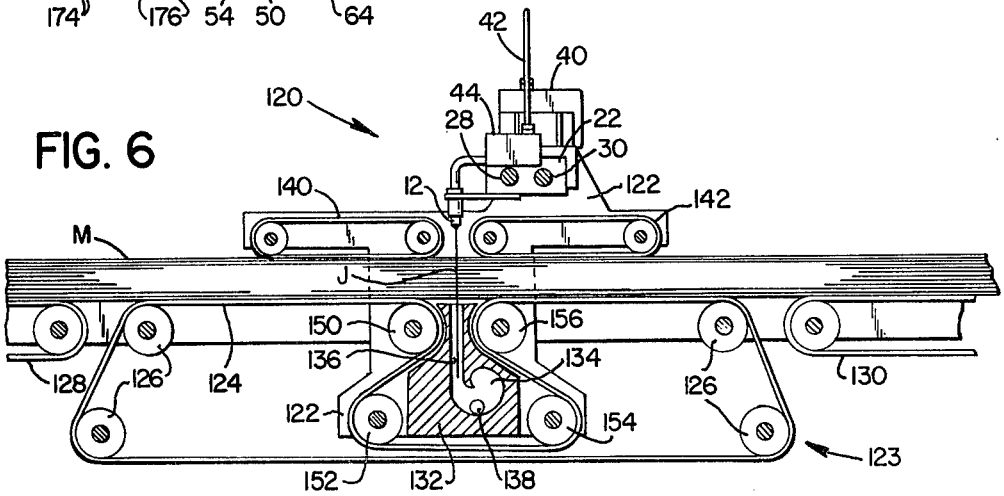

FLUID CUTTING JET RECEIVER

CROSS REFERENCE TO RELATED APPLICATION

This application is a continuation-in-part of copending application Ser. No. 488,158 filed July 12, 1974, now abandoned.

BACKGROUND OF THE INVENTION

The present invention relates to the field of cutting and, more particularly, it is concerned with cutting sheet materials such as limp fabrics, plastics, paper and similar products by means of high velocity fluid cutting jets.

The use of a high velocity fluid cutting jet for cutting materials such as fabrics, wood and other products has been known for some time. The cutting jet is usually produced by forcing water through a nozzle at very high pressures ranging between 10,000 psi and 100,000 psi. The velocity of the fluids at these pressures varies between 1,000 and 3,000 feet per second but the quantity of fluid involved is minimal since the throat diameters of the nozzles are in the order of 0.004 inch to 0.015 inch. Nevertheless, the power associated with high velocity jets may be several horsepower or more and dissipating the energy of such a jet even after it has cut through sheet material is not a simple problem in a cutting machine that must be of practical size and must operate with a jet nozzle that is translated relative to a stationary machine frame.

If there are no space limitations at the side of the workpiece from which a cutting jet exits, the jet can be dissipated in a larger vat of the same fluid forming the jet or other material such as sand or gravel. When space limitations do not permit a large vat to be positioned along the axis of the jet, the jet from a stationary nozzle may be deflected by a series of stationary plates or baffles to some other location away from the cutting station where the jet is eventually dissipated. In a system having a nozzle which moves relative to a frame supporting the workpiece, however, none of the prior art methods are particularly suitable since they require a fairly large space to receive the jet and dissipate its energy. Furthermore, dissipating the jet in a limited space by impinging it directly upon a hard backing member behind or below the workpiece is also undesirable since the backsplatter of the jet contains a substantial portion of the jet energy and results in a broad dispersion of the fluid against the workpiece. In addition, continual impingement of the high power jet at a single point on the backing member will eventually result in erosion or destruction of the member.

It is, accordingly, a general object of the present invention to disclose a receiver for a high velocity fluid jet that is capable of dissipating the energy of the jet in a cutting machine without deterioration over extended periods of time.

SUMMARY OF THE INVENTION

The present invention resides in a fluid jet receiver utilized in a cutting machine having a cutting tool including a fluid jet nozzle. The nozzle produces a high velocity fluid cutting jet along an axis directed toward a support surface on which a workpiece is laid to be cut by the jet.

The jet receiver is positioned to intercept the cutting jet after it passes through the workpiece and includes a jet deflection chamber having an inlet aligned with the jet axis issuing from the workpiece. The deflection chamber in a preferred embodiment of the invention is a vortex chamber having the inlet located tangentially of the interior chamber wall. As the jet passes into the chamber, it is whirled or deflected in a circular path against the inner wall until substantially all of its energy is dissipated.

For cutting machines in which the nozzle is moved relative to a workpiece, such as sheet material, in one or more coordinate directions during the cutting operation, the chamber may be mounted to move with the nozzle so that the inlet is always in registry with the jet or the inlet and deflection chamber may be designed to register with the jet at any point within its field of movement. For example, in cutting machines in which the nozzle is moved in two coordinate directions relative to sheet material, the receiver may be moved with the nozzle in one coordinate direction and the inlet may be elongated to continually register with the jet in the other coordinate direction.

By directing the high velocity cutting jet into a deflection chamber after it passes through a workpiece, it is possible to dissipate the fluid energy in a relatively limited space adjacent the side of the workpiece from which the jet issues. Effectively, a relatively long path over which a jet is deflected is folded into a confined space by virtue of the deflection chamber.

BRIEF DESCRIPTION OF THE DRAWINGS

FIG. 3 is a fragmentary cross-sectional view of the cutting machine as viewed along the sectioning line 3—3 of FIG. 1.

FIG. 5 is a cross-sectional view of a cutting machine illustrating another embodiment of the present invention.

FIG. 6 is a cross-sectional view of a cutting machine illustrating still another embodiment of the present invention.

FIG. 7 is a fragmentary cross-sectional view of the cutting machine similar to FIG. 2 showing another embodiment of the present invention.

DESCRIPTION OF THE PREFERRED EMBODIMENTS

Figure 1:
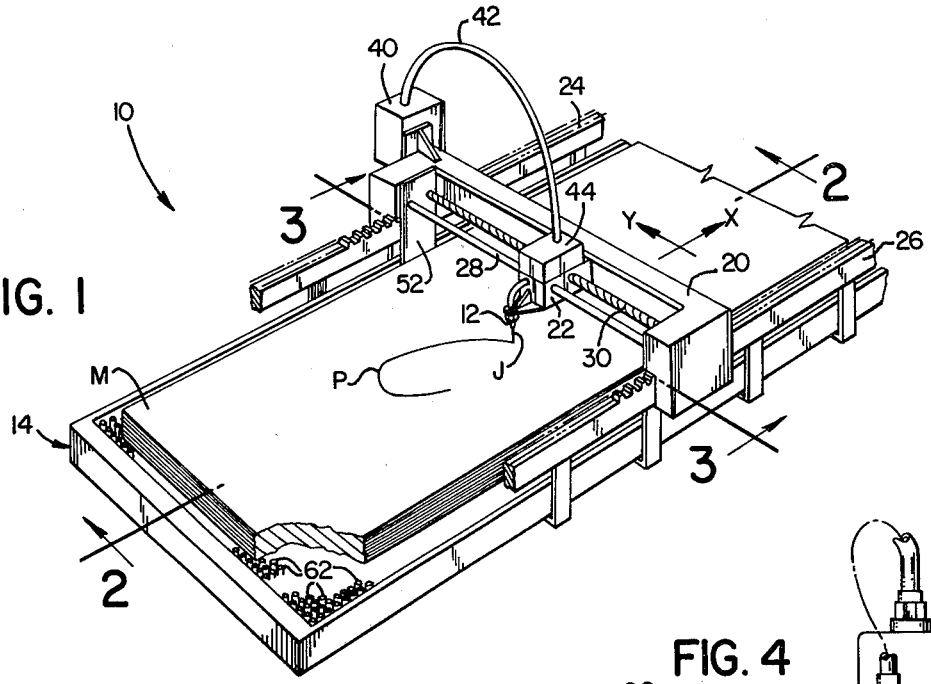
FIG. 1 is a perspective view of a cutting machine having a fluid jet nozzle as the cutting tool and a fluid jet receiver in accordance with the present invention.

FIG. 1 illustrates a cutting machine, generally designated 10, having a cutting tool in the form of a fluid jet nozzle 12. The nozzle produces a high velocity fluid cutting jet J which is directed along a jet axis from the nozzle through a workpiece mounted on the cutting machine 10. The illustrated workpiece is a layup of limp fabric material such as used in making upholstery or garments but could also be other types of sheet material including wood, plastics, thin metal foils, paper, leather and similar products.

The cutting machine 10 includes a support table 14 and a carriage mechanism from which the nozzle 12 is supported for movement relative to the table and the sheet material being cut. The carriage mechanism includes an X-carriage 20 which straddles the table and a Y-carriage 22 mounted on the X-carriage. The X-carriage moves on gear racks 24 and 26 relative to the table 14 in the illustrated X-coordinate direction while the Y-carriage moves on a guide rail 28 and a lead screw 30 on the X-carriage relative to the table and the X-carriage in the illustrated Y-coordinate direction. The nozzle 12 is supported from the Y-carriage and is directed toward the sheet material on the table. Composite motions of the X- and Y-carriages 20 and 22 allow the fluid cutting jet to be moved through various coordinate locations on the table which may define a cutting path P on the sheet material. As a result of the cutting operation, a plurality of similarly shaped pattern pieces having contours defined by the cutting path can be cut from the layup of material. The X- and Y-motions of the carriages are determined by a cutting program previously recorded or generated simultaneously with the cutting operation, and the actual movements of the carriage and operation of the jet J are produced by servomechanisms responding to the program.

Fluid for the cutting jet J is delivered from a pump 40 at one side of the X-carriage 20 through a flexible conduit 42 to a hydraulic intensifier 44 mounted on the Y-carriage 22. The pump 40 produces an output pressure on the order of 3,000 psi and that pressure is boosted to the operating pressure of the nozzle 12 in the range of 10,000 psi to 100,000 psi by the intensifier 44. Pumps and hydraulic intensifiers of this type are known in the art. The high pressure fluid then passes through the nozzle 12 having a throat diameter in the range of 0.004 inch to 0.015 inch so that an extremely fine, high-velocity fluid jet is directed through the sheet material M along the jet axis generally perpendicular to the plane of the material and the support table 14.

In accordance with the present invention and as shown in greater detail in the cross-sectional views in FIGS. 2 and 3, a fluid jet receiver 50 is suspended below the nozzle 12 to intercept the fluid jet J as it exits from the underside of the sheet material M. The receiver 50 extends laterally under the sheet material in the Y-coordinate direction and is suspended from the X-carriage 20 by means of a pair of side plates 52 (only one visible in FIGS. 1–3) at opposite lateral sides of the table 14. Therefore, when the X-carriage 20 is driven along the table 14, the nozzle 12 and receiver 50 maintain the same positional relationship in the X-coordinate direction.

The receiver 50 includes a jet-deflection chamber or vortex chamber 54 into which the fluid jet passes and in which the jet is dissipated by being deflected or whirled in a circular or helical path. The chamber 54 has a curved or generally cylindrical inner wall with the cylinder axis perpendicular to the jet, and includes an inlet passageway 56 leading into the chamber tangentially of the wall. The lengths of the cylindrical chamber 54 in the axial direction and the inlet passageway in the Y-coordinate direction are co-extensive with one another and are slightly greater than the excursion of the nozzle 12 and the carriage 22 in the Y-coordinate direction. Therefore, the inlet 56 is always in registry with the high velocity fluid jet J issuing from the nozzle, and the chamber 54 receives the jet for dissipation of its energy at any coordinate location that can be reached on the table 14 of the cutting machine 10. Thus, as the jet J exits from the layup of sheet material M, it is deflected into a generally circular path within the chamber 54 and is whirled around in the chamber against the cylindrical walls until the energy of the fluid forming jet is dissipated in friction with the walls or other fluid in the chamber.

The chamber 54 also includes a lip 57 in the cylindrical wall at the inner junction with the inlet 56. The lip has a radius of curvature decreasing as the tip of the lip is reached so that the fluid entering the chamber is turned in a smaller and smaller circle as the distance along the wall from the inlet increases. The lip assists in producing a tight, high speed vortex to reduce pressure in the chamber 54 and prevent flow out of the inlet.

The dissipation of many horsepower in the jet may create heating which will cause some of the fluid forming the jet, usually water, to vaporize. Also, since the fluid cutting jet J acts as a high powered aspirator, a large quantity of ambient air is drawn by the jet into the chamber 54, and thus, raises chamber pressure. Unless means is provided for evacuating the chamber, the fluid and vapor within the chamber would be forced upwardly into the inlet at locations other than that occupied by the jet. The sheet material M passing over the inlet would thus become wet and saturated with the jet fluid.

To evacuate the chamber and prevent wetting of the sheet material, an evacuation conduit 58 shown most clearly in FIG. 3 is connected to one or both axial ends of the chamber 54 and a flexible evacuation hose 60 leads from the conduit 58 to a vacuum pump (not shown) for removing from the chamber 54 the spent jet fluid, fluid vapors, aspirated air and suspended solids from the cutting operation. The capacity of the vacuum pump is established to maintain a pressure in the chamber lower than the ambient pressure at the inlet 56. The evacuated fluid may be filtered and recycled through the pump 40 or may simply be disposed of as waste.

It will be noted that the end of the flexible hose 60 connected to the conduit 58 must move back and forth in the X-direction with the X-carriage 20 and receiver 50. Such movement of the hose can be readily accomplished by laying the hose in a trough shown at the side of the support table 14. If the hose is folded back upon itself to form a double layer of hose extending along at least half of the length of the table 14 in the X-direction when the X-carriage 20 is at one end of the table, the fold will roll back and forth with the movements of the X-carriage 20 without sliding the full length of hose in the trough.

The receiver 50 is effectively on a foot suspended from the X-carriage 20 for movement under the sheet material during the cutting operation. To accommodate the receiver, the table 14 is provided with a deformable bed which defines the support surface on which the sheet material is laid. In the embodiment of the invention shown in FIGS. 1–3. the deformable bed is comprised of a plurality of elongated members displaced by the receiver 50 as the carriage 20 translates over the bed in the illustrated X-direction. The members are depressible pins 62 which project upwardly from the table 14 and have their free ends lying in a closely packed array in the plane of the support surface on which the sheet material M is positioned. The plurality of pins 62 are respectively supported from the base 64 of the table by a corresponding plurality of rods 66 anchored in the base and are resiliently urged toward the sheet material by coil springs 68 mounted coaxially on each of the rods 66. The pins 62 have hollow interiors which permit them to telescope onto the rods 66 and compress the springs 68 as the receiver 50 moves over the table 14 in the X-direction. An intermediate bulkhead 70 is provided within the bed 14 and apertures in the bulkhead fit in closely spaced relationship with the pins to hold vertical alignment and to permit sliding movement of the pins. Flanges (not visible) at the bottom ends of the pins 62 engage the bulkhead 70 to limit their upward movement and to locate the free ends of the pins in a common plane defining the support surface for the material M.

The lower contour of the receiver 50 is defined mainly by two sloping planes which serve as camming surfaces for displacing the pins 62. The upper ends of the pins 62 may be provided with rollers that are engaged by the camming surfaces to reduce frictional drag on the receiver as the X-carriage 20 translates over the sheet material on the table 14. The receiver 50 is positioned at a level below the X-carriage 20 by the plates 52 so that the upper surface of the receiver lies in the same plane as the support surface defined by the pins 62. In a preferred form of the receiver, a plurality of passageways 80 connecting with a common channel 82 extend to the upper surface of the receiver so that a supply of air can be delivered to the region between the receiver 50 and the sheet material M and produce an air bearing or cushion that minimizes friction between the material and the moving receiver. The channel 82 can be connected with an air source carried on the X-carriage 20 or may be supplied through a flexible hose from a stationary source adjacent the table 14.

Figure 4:
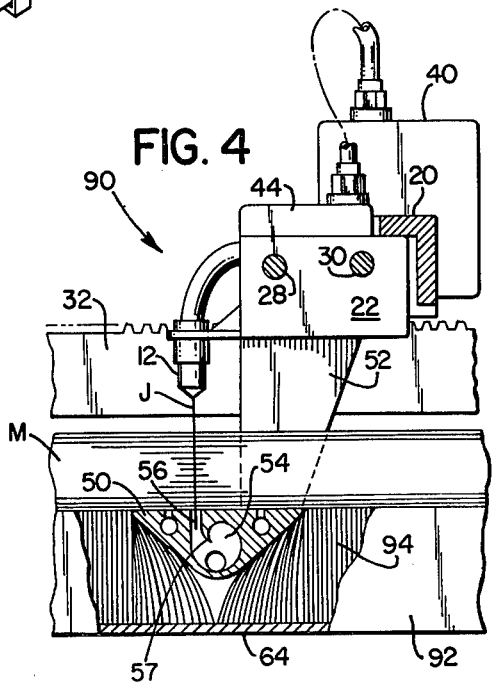
FIG. 4 is a cross-sectional view of the cutting machine similar to FIG. 2 and illustrates an alternate embodiment of the present invention.

FIG. 4 discloses an alternate embodiment of the cutting machine, generally designated 90, in accordance with the present invention. Components corresponding to those previously described in connection with the embodiment of FIGS. 1–3 operate in the same basic fashion as described above and bear the same reference numerals. A principal feature of the machine 90 is the deformable bed 92. Instead of the displaceable pins shown in FIG. 2, a plurality of elongated bristles 94 are anchored in the base 64 of the table and the free, upper ends of the bristles define the support surface on which the sheet material M is positioned.

Figure 2:
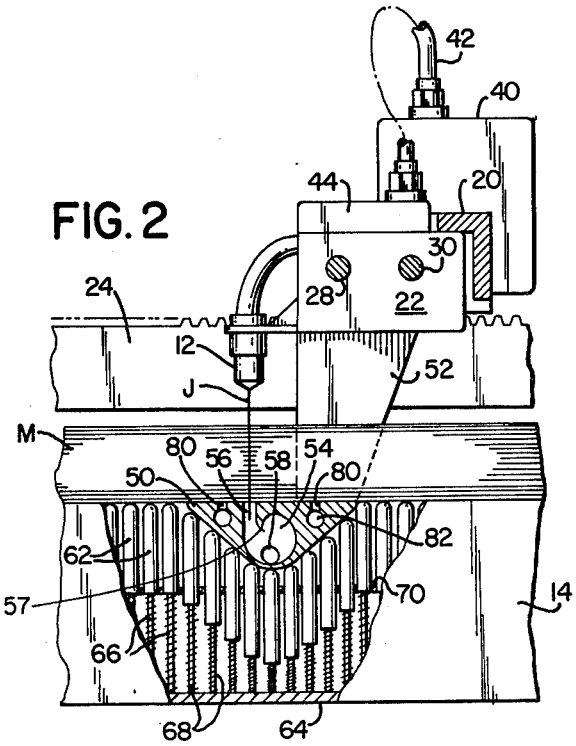
FIG. 2 is a fragmentary cross-sectional view of the cutting machine as viewed along the sectioning line 2—2 in FIG. 1.

In operation, the cutting machine 90 is similar to the machine 10 shown in FIGS. 1–3. The receiver 50 is positioned with its upper surface coplanar with the support surface defined by the bristles 94 and moves through the deformable bed 92 as the X-carriage 20 translates over the sheet material. The sloping lower surfaces of the receiver 50 merely deflect the bristles 94 as the receiver moves through the bed, and the bristles resume their vertical position after the receiver has passed. The bristles are collectively arranged in a closely packed array that is sufficiently rigid to define a support surface for holding the material stationary relative to the rest of the cutting machine 90.

FIG. 5 discloses another embodiment of the cutting machine generally designated 100, in which components corresponding to those described above in connection with FIGS. 1–4 have the same reference numerals. The cutting machine 100 differs from the previously described machines 10 and 90 in that the table 102 is not provided with a deformable bed and the receiver 104 has an upper surface contoured to lift the sheet material M slightly as the receiver translates relative to the material in the X-direction during a cutting operation. The receiver is supported by means of side plates 106 from the X-carriage for movement with the jet nozzle 12 in the X-coordinate direction but the side plates locate the receiver immediately adjacent the base or floor 108 of the table. Wheels, air passages or other bearing means may be provided at the upper and lower surfaces of the receiver 104 to minimize friction between the receiver, the material and the table during movement of the X-carriage 20. The contoured airfoil shape of the receiver 104 minimizes the disturbance or movement of the sheet material during the cutting operation and also provides space for a jet-deflection or vortex chamber 110 within the receiver. The construction and operation of the chamber 110 is the same as that of the chamber 54 described above and allows the fluid cutting jet J to be dissipated in a relatively small space after it exists from the sheet material M.

Another embodiment of the cutting apparatus, generally designated 120, is illustrated in FIG. 6 wherein corresponding components bear the same reference numerals as above. In this embodiment of the invention, the jet nozzle 12 is mounted on a Y-carriage 22 for movement in and out of the plane of the drawing on the guide rail 28 and lead screw 30. The rail 28 and screw 30 are mounted on an X-carriage 20 which straddles the layup of sheet material M and forms part of the machine 120. Accordingly, the jet 12 moves relative to the frame of the machine 120 in the X- and Y-coordinate directions in accordance with the corresponding carriage movements.

The sheet material M is supported on a conveyor 123 including an endless belt 124 and a plurality of guide rollers 126, 150, 152, 154 and 156 over which the belt is stretched so that a loop is formed in the belt at the cutting station defined by the nozzle 12. The rollers 150, 152, 154 and 156 are mounted on a sideplate 122 suspended from the X-carriage 20 so that the rollers and the loop in the conveyor belt 124 travel with the X-carriage and remain at the cutting station as the nozzle 12 translates over the sheet material M during a cutting operation without moving the material. Traveling belts 140 and 142 spaced at opposite sides of the cutting station are suspended from the X-carriage 20 and rest on the upper surface of the sheet material layup to hold the material in place. When the sheet material is to be loaded onto or removed from the conveyor belt 124, the rollers 126 are rotated by a separate drive motor to cause the conveyor 123 to move the sheet material in the X-coordinate direction onto one or the other of the auxiliary conveyors 128 and 130 at opposite ends of the machine 120. A more detailed description of a cutting table having the moving loop and the supporting conveyor may be had by reference to U.S. Pat. No. 3,262,348.

Mounted within the loop of the conveyor 123 is a fluid jet receiver 132. The receiver is suspended from the sideplate 122 in the same manner as the rollers 150, 152, 154 and 156 so that movements of the nozzle 12 in the X-coordinate direction are accompanied by corresponding movements of the receiver. A jet deflection chamber 134 resembling that shown in the previous embodiments of the invention is provided in the receiver and an inlet 136 to the chamber extends tangentially into the inner cylindrical wall of the chamber. The inlet 136 is somewhat deeper than the inlets described above in order to locate the chamber 134 below the rollers 150 and 156 and extends in the Y-coordinate direction a distance coextensive with that traversed by the nozzle 12 in the same direction. An evacuation conduit 138 similar to the conduit 58 described above allows spent fluid from the jet to be removed from the chamber 134 and recycled through the pump 40 or disposed of as waste.

Thus, the receiver 132 moves with the X-carriage 22 and remains at all times in the loop formed by the conveyor 123 with the inlet in registry with the jet J at the cutting station. The upper surface of the receiver lies in the same plane as the support surface of the conveyor on which the sheet material M rests and fills the gap between the rollers 150 and 156 to minimize any disturbance of the material during the cutting operation.

FIG. 7 discloses another embodiment of a deformable bed which supports the sheet material M (in phantom) during a cutting operation and which accommodates the fluid jet receiver below the support surface as the sheet material is cut by the fluid jet J. The receiver 50 with the jet deflection chamber 54 has the same construction as and is suspended from the X-carriage 20 in the same manner as that shown and described in connection with FIGS. 1–4.

The deformable bed, designated 170, is comprised of a plurality of slats 172 which extend from one side of the table to the other in the Y-coordinate direction parallel with the jet receiver 50. The slats are located in side-by-side relationship and together define the supporting surface on which the sheet material M is placed during the cutting operation. The opposite ends of each slat are captured on upright rods 174 at each lateral side of the table and are urged upwardly by springs 176 mounted coaxially about the rods. The slats are normally positioned in a common plane at the support surface of the bed 170 by means of flattened heads 178 at the upper end of each rod. The rods 174 extend in sliding relationship through guide holes at the ends of the slats 172 so that the slats may move up and down on the rods in opposition to the biasing forces of the springs 176.

The springs 176 apply sufficient force to the slats 172 to position the slats against the heads 178 when a layup of sheet material is resting on the slats. When the jet receiver 50 translates under the layup, however, the camming surfaces on the lower side of the receiver depress the slats as illustrated and allow the receiver to slide under the bottom ply of the layup without disturbing the sheet material. The jet deflection chamber 54 in the receiver dissipates the jet J after it penetrates through the sheet material and discharges the spent fluid as described above.

Figure 8:
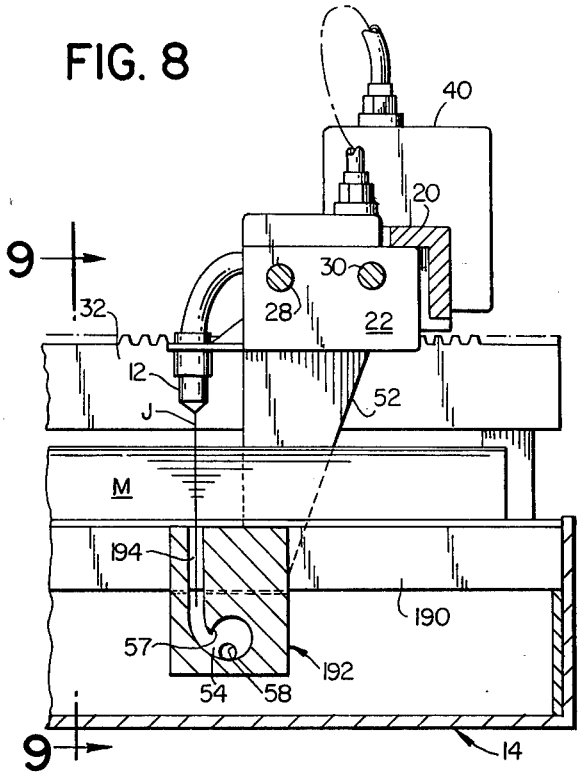
FIG. 8 is a cross-sectional view of a cutting machine similar to FIG. 2 and illustrates still another embodiment of the present invention.
Figure 9:
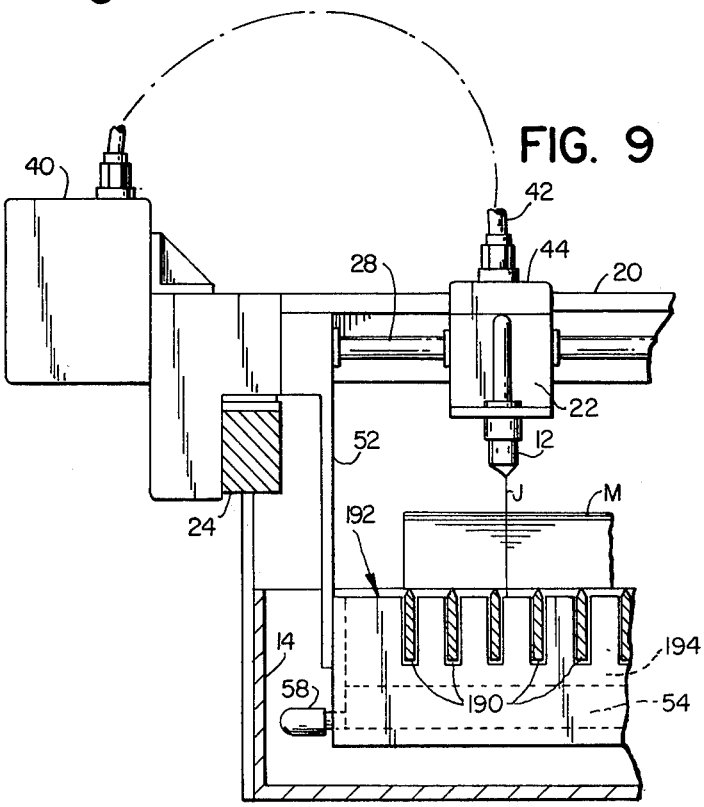
FIG. 9 is a fragmentary cross-sectional view of the invention in FIG. 8 viewed along the sectioning line 9—9.

FIGS. 8 and 9 illustrate still another embodiment of a fluid jet receiver and a cooperating bed for supporting the sheet material in a spread condition. Elements corresponding to those previously described bear the same reference numerals as above.

Unlike the deformable beds of the support tables shown in FIGS. 2–4, 6 and 7, the bed shown in FIGS. 8 and 9 is comprised of a plurality of elongated, relatively rigid and parallel bars 190 that extend from one end of the table to the other in the X-coordinate direction illustrated in FIG. 1. The upper edges of the bars are sharpened to form knife edges which lie in a common plane and define the support surface of the table on which the sheet material M is laid. The knife edges split an impinging fluid jet without backsplatter that would wet the sheet material. The spacing of the parallel bars is relatively small, for example, not more than a few inches, in order to prevent the sheet material from sagging between the bars as the material rests on the knife edges under its own weight. If desired, thin wires may be laid transversely across the knife edges of the bars to provide additional support for the material.

A fluid jet receiver 192 is suspended below the X-carriage 20 by means of the sideplates 52 in the same manner as the receivers in FIGS. 2–4 so that the receiver translates in the X-coordinate direction with the jet nozzle 12. The receiver has a jet deflection or vortex chamber 54 which is coextensive with the receiver in the Y-coordinate direction and leads to an evacuation conduit 58 at at least one end of the chamber. The inlet 194 of the receiver 192 is a slit-type inlet, such as the inlet 56 in FIGS. 2–4, and extends through the receiver in the Y-coordinate direction by an amount equal to or greater than the excursion of the Y-carriage 22 over the bed of the support table 14. The inlet extends below the parallel bars 190 in alignment with the fluid jet J from the nozzle 12 and remains in registration with the fluid jet at all times while the sheet material M on the bars is being cut.

As illustrated most clearly in FIG. 9, the upper part of the receiver 192 has a plurality of slots which extend through the receiver in the X-coordinate direction and coincide respectively with the plurality of parallel bars 190 passing through the slots. Preferably, the bars and the slots mate in close-fitting relationship to provide a fluid seal in the regions where the bars and the receiver overlap at opposite sides of the inlet 194. As the X-carriage 20 moves over the sheet material in the X-coordinate direction, the bars 190 slide through the respective slots and thus, in effect, the bars are "combed" by the receiver 192. The upper surface of the receiver confronting the bottom of the sheet material layup is preferably spaced slightly below the support plane determined by the knife edges of the bars so that the receiver slides easily beneath the sheet material without disturbing the lower plies.

When the jet J enters the inlet 194 of the receiver, it passes downwardly into the vortex chamber 54 where it is dissipated regardless of the position in the sheet material being cut. If the jet happens to be situated above one of the supporting bars 190, it impinges upon the knife edge and passes into the vortex chamber on one or both sides of the bar. The overlap of the receiver and the bars at either side of the inlet provides a sufficient seal to prevent any spray of the jet from leaving the receiver; however, if a small degree of leakage is observed, an auxiliary drain in the bottom of the cutting table 14 can be provided to remove the spent fluid.

In summary, a cutting machine employing a receiver for dissipating the energy of a high velocity fluid cutting jet has been disclosed in several different embodiments. Numerous modifications and substitutions can be had in the disclosed embodiments without departing from the spirit of the invention. For example, it is recognized that a receiver for the high velocity fluid cutting jet need not have a dimension in the Y-coordinate direction coextensive with the maximum displacement of the jet in the same direction. Instead, a receiver of smaller size can be mounted or movement in the Y-coordinate direction in conjunction with the Y-carriage movement so that the inlet of the receiver always registers with the jet exiting from the sheet material. The specific pumping arrangements illustrated and described for the jet nozzle are not the only arrangements suitable for use with the invention, and the pump or hydraulic intensifier can be located remotely of the carriage mechanisms for the cutting machine. In the embodiments of FIGS. 2,3 and 7 the pins or slats which are depressed by the receiver as it moves along the cutting table can alternatively be power actuated and programmed to retract slightly in advance of the receiver and return to the supporting positions after the receiver has passed. Still other forms of supporting beds which locally deform as the fluid jet receiver translates immediately under the sheet material may be comprised of compressible foam or air- or water-filled bags which are easily deformed. A series of parallel, edge-mounted slats extending in the Y-coordinate direction under the sheet material and hinged at the lower edge to deflect under the receiver may also define a support surface that is deformed either by the receiver itself or by a powdered, programmed control mechanism. Accordingly, the present invention has been described in several preferred embodiments by way of illustration rather than limitation.

We claim:

1. In a cutting machine having a cutting tool including a fluid jet nozzle having a jet axis directed toward a support surface on which a workpiece is laid to be cut by a high velocity fluid cutting jet issuing from the nozzle and passing along the axis toward the workpiece, the nozzle being mounted on a tool carriage for movement generally parallel to the support surface and material supported on the surface, the improvement comprising:

a fluid jet receiver suspended from the tool carriage at the side of the support surface opposite from the nozzle for movement with the jet nozzle parallel to the support surface and positioned to intercept the fluid cutting jet after the jet passes through the workpiece on the support surface and including a jet deflection chamber having a curved inner wall and an inlet aligned with the jet axis and leading into the interior of the deflection chamber tangentially of the curved inner wall.

2. The improvement of claim 1 wherein:

the jet deflection chamber in the receiver is a vortex chamber.

3. The improvement of claim 2 wherein:

the vortex chamber is a generally cylindrical chamber having a cylindrical inside wall with the inlet extending into the chamber tangentially of the inside wall.

4. The improvement of claim 3 wherein the inlet is coextensive in the axial direction of the chamber with the cylindrical inside wall.

5. The improvement of claim 2 wherein the vortex chamber is positioned with the central axis of the chamber in a plane perpendicular to the fluid jet at the inlet.

6. The improvement of claim 1 wherein:

the jet deflection chamber also has a fluid drain for discharging fluid from the jet.

7. The improvement of claim 2 wherein:

the vortex chamber has a generaly cylindrical inside wall with a tangential inlet and includes at least one wall portion having a radius of curvature decreasing as the distance along the wall from the inlet increases to produce a tight, high velocity vortex from the jet entering the chamber through the inlet.

8. The improvement of claim 1 further including:

means for evacuating the jet deflection chamber.

9. The improvement of claim 8 wherein:

the means for evacuating comprises means for reducing the pressure within the chamber below the ambient pressure at the inlet.

10. In a cutting machine having a carriage movable relative to a workpiece positioned on a support surface, the improvement comprising:

a fluid jet nozzle mounted on the carriage and directed toward the support surface for producing a high velocity fluid cutting jet which makes continuous cuts along cutting paths over the workpiece as the carriage moves relative to the workpiece;

a foot suspended from the carriage and under the workpiece for movement with the carriage and jet nozzle relative to the workpiece; and a fluid jet receiver mounted on the foot and including a jet deflection chamber having an inlet located in alignment with the fluid jet from the nozzle to intercept and receiver the jet exiting from the workpiece.

11. The improvement of claim 10 in a cutting machine in which the carriage moves relative to the workpiece in a first coordinate direction and the fluid jet nozzle is mounted for movement on the carriage in a second coordinate direction, the first and second directions both being parallel to the support surface, wherein:

the carriage extends over the workpiece in the second coordinate direction;

the foot extends under the workpiece in the second coordinate direction; and the inlet of the jet deflection chamber also extends in the second direction on the foot.

12. The improvement of claim 10 wherein the foot is suspended from the carriage immediately above the support surface.

13. The improvement of claim 10 wherein:

the foot is suspended from the carriage with at least one portion extending below the plane in which the support surface for the sheet material lies; and the cutting machine includes a deformable bed defining the support surface in said plane and deformed below said plane by the foot.

14. The improvement of claim 13 wherein:

the deformable bed is comprised of a plurality of elongated displaceable members having free ends lying in a closely packed array in said plane and defining the support surface.

15. The improvement of claim 14 wherein:

the deformable bed is comprised of a plurality of depressible pins resiliently supported in a frame of the bed.

16. The improvement of claim 14 wherein:

the deformable bed is comprised of a plurality of deflectible bristles.

17. The improvement of claim 10 wherein:

means for generating a fluid cushion between the foot and the workpiece are mounted on the foot.

18. The improvement of claim 13 wherein:

the carriage is movable relative to the workpiece in one coordinate direction; and the deformable bed is comprised of a plurality of resiliently supported slats extending perpendicular to said one coordinate direction and in parallel relationship with each other at the plane in which the support surface lies and thereby defining the support surface.

19. The improvement of claim 18 wherein:

the deformable bed includes rods perpendicular to said plane of the support surface and arranged in rows at opposite sides of the table; and the resiliently supported slats have opposite ends captured on and slidable along the rods respectively at the opposite sides of the table.

20. Apparatus for cutting sheet material with a fluid jet comprising:

a cutting table having a bed defining a support surface for holding limp sheet material in a spread condition for cutting a carriage movable relative to the cutting table and parallel with sheet material spread on the support surface of the bed;

a fluid jet nozzle mounted on the tool carriage for movement with the carriage relative to the sheet material, and directed toward the material on the support surface;

fluid means connected with the jet nozzle for supplying pressurized fluid to the nozzle and sending a high velocity fluid cutting jet from the nozzle into the limp sheet material on the support surface; and a fluid jet receiver positioned at the one side of the sheet material opposite the nozzle to intercept the cutting jet after the jet exits from the sheet material supported on the support surface, the receiver being suspended from the movable carriage and having a jet inlet registering with the nozzle and movable with the carriage to maintain registration of the jet and inlet and receive the exiting jet.

21. Apparatus for cutting sheet material as defined in in claim 20 wherein:

the bed of the cutting table is a deformable bed defining a support surface of the sheet material in one plane and being deformable below said plane and away from the sheet material; and the fluid jet receiver is mounted in the deformable bed for movement with the nozzle.

22. Apparatus for cutting sheet material as defined in claim 21 wherein the deformable bed comprises a belt extending between opposite ends of the support surface on which the sheet material rests, and deformable between the opposite ends in a loop below the plane of the support surface; and the fluid jet receiver is positioned within the loop.

23. Apparatus for cutting sheet material as defined in claim 21 wherein the deformable bed comprises a bed of flexing members having upper ends located in the plane defined by the support surface and lower ends attached to the bed; and the fluid jet receiver is mounted for movement in an opening of the bed formed by flexing the upper ends of the members relative to the lower ends attached to the bed.

24. Apparatus for cutting sheet material as defined in claim 23 wherein the deformable bed comprises a bed of elongated bristles.

25. Apparatus for cutting sheet material as defined in claim 20 wherein the movable carriage on which the jet nozzle is mounted is movable above the support surface of the bed and sheet material thereon in one of two coordinate directions parallel to the support surface; the jet inlet of the fluid jet receiver is elongated in the other of the two coordinate directions to receive the jet at a plurality of stations along the other coordinate; and the receiver is movable with the nozzle and carriage relative to the cutting table in the one of the two coordinate directions.

26. Apparatus for cutting sheet material as defined in claim 25 wherein the fluid jet receiver has a plurality of slots extending through the receiver in the one coordinate direction; and the bed of the cutting table is comprised by a corresponding plurality of bars extending in the one coordinate direction through the slots of the receiver and having exposed edges in a common plane defining the support surface of the table bed.

27. Apparatus for cutting sheet material as defined in claim 26 wherein the exposed edges of the bars are knife edges.

28. A fluid cutting machine for sheet material comprising:

a cutting bed defining a horizontal support surface on which sheet material is positioned for cutting;

a carriage mounted for movement relative to the bed;

a fluid jet nozzle positioned on the carriage and producing a fluid cutting jet extending from the carriage to the sheet material to be cut on the support surface of the bed;

a fluid jet receiver positioned below the sheet material on the bed and having an inlet registering with the fluid jet from the nozzle; and means for moving the fluid jet receiver and the nozzle relative to the sheet material and maintaining the fluid jet receiver and the nozzle in registration, the means for moving including a member suspending the fluid jet receiver from the movable carriage on which the nozzle is positioned.

29. A fluid jet cutting machine as defined in claim 28 wherein the cutting bed is a deformable bed and the fluid jet receiver is positioned to move under the sheet material in a deformed portion of the bed.

* * * * *

UNITED STATES PATENT OFFICE

CERTIFICATE OF CORRECTION

Patent No. 4,137,804 Dated February 6, 1979

Inventor(s) Heinz J. Gerber and David R. Pearl

It is certified that error appears in the above-identified patent and that said Letters Patent are hereby corrected as shown below:

Column 1, line 34, "larger" should be --large--.

Column 2, Line 39, "of" should be --in--.

Column 9, line 16, "powdered" should be --powered--.

Column 11, line 11, insert --;-- after "cutting".

Column 11, line 34, "of" should be --for--.

Signed and Sealed this

*First* Day of *May 1979*

[SEAL]

*Attest:*

RUTH C. MASON
*Attesting Officer*

DONALD W. BANNER
*Commissioner of Patents and Trademarks*